US006362155B1

(12) United States Patent
Kinscherf

(10) Patent No.: US 6,362,155 B1
(45) Date of Patent: Mar. 26, 2002

(54) THICKENED MICROEMULSION CLEANING COMPOSITIONS COMPRISING XANTHUM GUM

(75) Inventor: Kevin Kinscherf, Freehold, NJ (US)

(73) Assignee: Colgate-Palmolive Co., Piscataway, NJ (US)

( * ) Notice: Subject to any disclaimer, the term of this patent is extended or adjusted under 35 U.S.C. 154(b) by 0 days.

(21) Appl. No.: 09/957,868

(22) Filed: Sep. 21, 2001

(51) Int. Cl.[7] ..... C11D 17/00

(52) U.S. Cl. ..... 510/417; 510/365; 510/422; 510/424; 510/499; 510/506

(58) Field of Search ..... 510/417, 365, 510/422, 499, 506, 505, 424

(56) References Cited

U.S. PATENT DOCUMENTS

| | | | | | |
|---|---|---|---|---|---|
| 4,244,840 | A | * | 1/1981 | Straw | 252/540 |
| 4,414,128 | A | * | 11/1983 | Goffinet | 252/111 |
| 4,540,505 | A | * | 9/1985 | Frazier | 252/106 |
| 5,082,584 | A | * | 1/1992 | Loth et al. | 252/122 |
| 6,228,832 | B1 | * | 5/2001 | Kinscherf et al. | 510/417 |

* cited by examiner

*Primary Examiner*—Necholus Ogden
(74) *Attorney, Agent, or Firm*—Richard E. Nanfeldt

(57) ABSTRACT

An improvement is described in microemulsion composition which has superior cling to a vertical surface and is especially effective in the removal of oily and greasy soil and are mild to the skin, containing an anionic detergent, a thickener, a hydrocarbon ingredient, a cosurfactant and water, wherein the composition has a pH of at least 12.5.

6 Claims, No Drawings

THICKENED MICROEMULSION CLEANING COMPOSITIONS COMPRISING XANTHUM GUM

FIELD OF THE INVENTION

The present invention relates to a microemulsion composition containing a cosurfactant, perfume, anionic surfactant, a polymeric thickener and water and having a pH of at least 12.5, wherein the composition exhibits mildness while having excellent grease cutting capacity as well as superior cling to a vertical surface.

BACKGROUND OF THE INVENTION

This invention relates to an improved thickened liquid microemulsion composition which has superior cling to a vertical surface and is designed in particular for cleaning dishware, pots and pans and hard surfaces and which is effective in removing burnt-on greasy soils leaving surfaces clean.

In recent years liquid detergents have become widely accepted for cleaning hard surfaces, e.g., painted woodwork and panels, tiled walls, wash bowls, bathtubs, linoleum or tile floors, washable wall paper, dishes, pots and pan etc. Such detergent liquids comprise clear and opaque aqueous mixtures of water-soluble synthetic organic detergents and water-soluble detergent builder salts. In order to achieve comparable cleaning efficiency with granular or powdered detergent cleaning compositions, use of water-soluble inorganic phosphate builder salts was favored in the prior art detergent liquids. These salts both complex hardness ions and provide alkalinity. These properties are well know to enhance soil removal. For example, such early phosphate-containing compositions are described in U.S. Pat. Nos. 2,560,839; 3,234,138; 3,350,319; and British Patent No. 1,223,739.

In view of the environmentalist's efforts to reduce phosphate levels in ground water, improved detergent liquids containing reduced concentrations of inorganic phosphate builder salts or non-phosphate builder salts have appeared. A particularly useful self-opacified liquid of the latter type is described in U.S. Pat. No. 4,244,840.

However, these prior art liquid detergents containing detergent builder salts or other equivalent tend to leave films, spots or streaks on cleaned unrinsed surfaces, particularly shiny surfaces. Thus, such liquids require thorough rinsing of the cleaned surfaces which is a time-consuming chore for the user. Simply removing builder salts will generate less effective compositions.

In order to overcome the foregoing disadvantage of the prior art detergent liquid, U.S. Pat. No. 4,017,409 teaches that a mixture of paraffin sulfonate and a reduced concentration of inorganic phosphate builder salt should be employed. However, such compositions are not completely acceptable from an environmental point of view based upon the phosphate content. On the other hand, another alternative to achieving phosphate-free detergent liquids has been to use a major proportion of a mixture of anionic and nonionic detergents with minor amounts of glycol ether solvent and organic amine as shown in U.S. Pat. No. 3,935,130. Again, this approach has not been completely satisfactory and the high levels of organic detergents necessary to achieve cleaning cause foaming which, in turn, leads to the need for thorough rinsing which has been found to be undesirable to today's consumers.

Another approach to formulating hard surfaced or liquid detergent compositions where product homogeneity and clarity are important considerations involves the formation of oil-in-water (o/w) microemulsions which contain one or more surface-active detergent compounds, a water-immiscible solvent (typically a hydrocarbon solvent), water and a "cosurfactant" compound which provides product stability. By definition, an o/w microemulsion is a spontaneously forming colloidal dispersion of "oil" phase particles having a particle size in the range of 25 to 800 Å in a continuous aqueous phase.

In view of the extremely fine particle size of the dispersed oil phase particles, microemulsions are transparent to light and are clear and usually highly stable against phase separation.

Patent disclosures relating to use of grease-removal solvents in o/w microemulsions include, for example, European Patent Applications EP 0137615 and EP 0137616—Herbots et al; European Patent Application EP 0160762—Johnston et al; and U.S. Pat. No. 4,561,991—Herbots et al. Each of these patent disclosures also teaches using at least 5% by weight of grease-removal solvent.

It also is known from British Patent Application GB 2144763A to Herbots et al, published Mar. 13, 1985, that magnesium salts enhance grease-removal performance of organic grease-removal solvents, such as the terpenes, in o/w microemulsion liquid detergent compositions. The compositions of this invention described by Herbots et al. require at least 5% of the mixture of grease-removal solvent and magnesium salt and preferably at least 5% of solvent (which may be a mixture of water-immiscible non-polar solvent with a sparingly soluble slightly polar solvent) and at least 0.1% magnesium salt.

However, since the amount of water immiscible and sparingly soluble components which can be present in an o/w microemulsion, with low total active ingredients without impairing the stability of the microemulsion is rather limited (for example, up to 18% by weight of the aqueous phase), the presence of such high quantities of grease-removal solvent tend to reduce the total amount of greasy or oily soils which can be taken up by and into the microemulsion without causing phase separation.

The following representative prior art patents also relate to liquid detergent cleaning compositions in the form of o/w microemulsions: U.S. Pat. No. 4,472,291—Rosario; U.S. Pat. No. 4,540,448—Gauteer et al; U.S. Pat. No. 3,723,330—Sheflin; etc.

Liquid detergent compositions which include terpenes, such as d-limonene, or other grease-removal solvent, although not disclosed to be in the form of o/w microemulsions, are the subject matter of the following representative patent documents: European Patent Application 0080749; British Patent Specification 1,603,047; and U.S. Pat. Nos. 4,414,128 and 4,540,505. For example, U.S. Pat. No. 4,414,128 broadly discloses an aqueous liquid detergent composition characterized by, by weight:

(a) from 1% to 20% of a synthetic anionic, nonionic, amphoteric or zwitterionic surfactant or mixture thereof;

(b) from 0.5% to 10% of a mono- or sesquiterpene or mixture thereof, at a weight ratio of (a):(b) being in the range of 5:1 to 1:3; and (c) from 0.5% 10% of a polar solvent having a solubility in water at 15° C. in the range of from 0.2% to 10%. Other ingredients present in the formulations disclosed in this patent include from 0.05% to 2% by weight of an alkali metal, ammonium or alkanolammonium soap of a $C_{13}$–$C_{24}$ fatty acid; a calcium sequestrant from 0.5% to 13% by weight; non-aqueous solvent, e.g., alcohols and glycol ethers, up to 10% by weight; and hydrotropes, e.g., urea, ethanolamines, salts of lower alkylaryl sulfonates, up to 10% by weight. All of the formulations shown in the Examples of this patent include relatively large amounts of detergent builder salts which are detrimental to surface shine.

Furthermore, the present inventors have observed that in formulations containing grease-removal assisting magnesium compounds, the addition of minor amounts of builder salts, such as alkali metal polyphosphates, alkali metal carbonates, nitrilotriacetic acid salts, and so on, tends to make it more difficult to form stable microemulsion systems.

U.S. Pat. No. 5,082,584 discloses a microemulsion composition having an anionic surfactant, a cosurfactant, nonionic surfactant, perfume and water; however, these compositions do not possess the ecotoxicity and the improved interfacial tension properties as exhibited by the compositions of the instant invention.

This invention relates to cleaning compositions in the form of liquids, sprays and gels, which remove dried-on and cooked-on food and other difficult-to-remove soils from kitchen utensils, flatware, dishes, glassware, cookware, bakeware, cooking surfaces and surrounding areas in a convenient, easy, timely and mild manner.

Of the difficult-to-remove soils, the most severe is the baked and/or burned-on (especially when reheated and/or allowed to build up over time). Soil categories include grease, meat (including skin), dairy, fruit pie filling, carbohydrate and starch. Soiled substrate categories include aluminum, iron, stainless steel, enamel, Corningware, Pyrex and other glass cookware.

U.S. Pat. No. 6,228,832 teaches a microemulsion cleaning containing an anionic surfactant, triethanol amine, cosurfactant, alkali metal hydroxide, perfume and water and having a pH of at least 12.5.

SUMMARY OF THE INVENTION

The present invention provides an improved, clear, liquid cleaning composition having improved interfacial tension which improves cleaning hard surfaces in the form of a microemulsion which is suitable for removing grease from dishware and hard surfaces such as plastic, vitreous and metal surfaces having a shiny finish, oil stained floors, automotive engines and other engines, wherein the compositions are mild to the skin. More particularly, the improved cleaning compositions exhibit superior cling to a vertical surface and have good grease soil removal properties due to the—and addition of a mild amount of alkalinity.

Surprisingly, these desirable results are accomplished even in the absence of polyphosphate or other inorganic or organic detergent builder salts.

In one aspect, the invention generally provides a stable, optically clear microemulsion, cleaning composition especially effective in the removal of oily and greasy oil. The dilute microemulsion composition includes, on a weight basis:

0.1% to 10% of an anionic surfactant;

0.05% to 3% of a thickener;

0.1% to 2%, more preferably 0.25% to 1.5% of triethanol amine;

3% to 20% of at least one water-mixable cosurfactant;

0.1% to 2.0% of an alkali metal hydroxide such as potassium hydroxide and/or sodium hydroxide;

0.2 to 10.0% of a perfume, essential oil, or water insoluble hydrocarbon having 6 to 18 carbon atoms; and the balance being water, wherein the composition has a pH of at least 12.5 and preferably at least about 13 and the composition does not contain an amine oxide surfactant, an alkyl polyglucoside surfactant, an ethoxylated nonionic surfactant, a zwitterionic surfactant, a fatty acid alkanol amide or an organic compound containing both ethoxylate groups and an ester group. The following thickeners are excluded from the instant composition because they fail to provide the proper rheological profile. These excluded thickeners are carrageenan, cellulose gum (KMO), hydroxyethyl cellulose (HEC), methyl cellulose, hydropropyl methyl cellulose, alumina, polygenic silicas, anionic polymers such as polyacrylic acid and polymethacrylic acid and nonionic synthetic polymers such as polyethylene glycol.

An object of the instant invention is to provide a composition which is effective in the removal of dirt especially on a vertical surface which has hardened on the surface or is baked on the surface such as the inside of an oven while providing a composition which has a low level of skin and eye irritation thereby permitting use of the product without having to use rubber protective gloves or eye protection.

DETAILED DESCRIPTION OF THE INVENTION

The present invention relates to a stable microemulsion composition comprising approximately by weight: 0.1% to 10% of an anionic surfactant, 0.01% to 3% of a thickener, 3% to 20% of at least one cosurfactant, 0.1 to 2%, more preferably 0.25% to 1.5% of triethanol amine, 0.4% to 1.2% of an alkali metal hydroxide auch as sodium hydroxide and/or potassium hydroxide, 0.05% to 10% of a water insoluble hydrocarbon, essential oil or a perfume and the balance being water, said composition has a pH of at least 12.5 and preferably at least about 13.0 and the composition does not contain an amine oxide surfactant, an alkyl polyglucoside surfactant, an ethoxylated nonionic surfactant, a zwitterionic surfactant, a fatty acid alkanol amide or an organic compound containing both ethoxylate groups and an ester group. The following thickeners are excluded from the instant composition because they fail to provide the proper rheological profile. These excluded thickeners are carrageenan, cellulose gum (KMO), hydroxyethyl cellulose (HEC), methyl cellulose, hydropropyl methyl cellulose, polyacrylamides, polyvinyl alcohol, alumina, polygenic silicas, anionic polymers such as polyacrylic acid and polymethacrylic acid and nonionic synthetic polymers such as polyethylene glycol.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to cleaning performance so long as it meets the criteria of water immiscibility and having a pleasing odor. Naturally, of course, especially for cleaning compositions intended for use in the home, the perfume, as well as all other ingredients, should be cosmetically acceptable, i.e., non-toxic, hypoallergenic, etc. The instant compositions show a marked improvement in ecotoxocity as compared to existing commercial products.

The hydrocarbon such as a perfume is present in the dilute o/w microemulsion in an amount of from 0.1% to 10% by weight, preferably from 0.4% to 3.0% by weight, especially preferably from 0.5% to 2.0% by weight.

Furthermore, although superior grease removal performance will be achieved for perfume compositions not containing any terpene solvents, it is apparently difficult for perfumers to formulate sufficiently inexpensive perfume compositions for products of this type (i.e., very cost sensitive consumer-type products) which includes less than 20%, usually less than 30%, of such terpene solvents.

Thus, merely as a practical matter, based on economic consideration, the dilute microemulsion detergent cleaning compositions of the present invention may often include as much as 0.2% to 7% by weight, based on the total composition, of terpene solvents introduced thereunto via the perfume component. However, even when the amount of terpene solvent in the cleaning formulation is less than 1.5% by weight, such as up to 0.6% by weight or 0.4% by weight or less, satisfactory grease removal and oil removal capacity is provided by the inventive diluted o/w microemulsions.

Thus, for a typical formulation of a diluted microemulsion according to this invention a 20 milliliter sample of microemulsion containing 1% by weight of perfume will be able to solubilize, for example, up to 2 to 3 ml of greasy and/or oily soil, while retaining its form as a microemulsion, regardless of whether the perfume contains 0%, 0.1%, 0.2%, 0.3%, 0.4%, 0.5%, 0.6%, 0.7% or 0.8% by weight of terpene solvent.

In place of the perfume in the microemulsion composition at the same previously defined concentrations that the perfume was used in the microemulsion composition one can employ an essential oil or a water insoluble hydrocarbon having 6 to 18 carbon such as a paraffin or isoparaffin.

Suitable essential oils are selected from the group consisting of: Anethole 20/21 natural, Aniseed oil china star, Aniseed oil globe brand, Balsam (Peru), Basil oil (India), Black pepper oil, Black pepper oleoresin 40/20, Bois de Rose (Brazil) FOB, Borneol Flakes (China), Camphor oil, White, Camphor powder synthetic technical, Cananga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Coumarin 69° C. (China), Cyclamen Aldehyde, Diphenyl oxide, Ethyl vanilin, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrefte, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), Wintergreen Regarding the anionic surfactant present in the microemulsions any of the conventionally used water-soluble anionic surfactants or mixtures of said anionic surfactants can be used in this invention. As used herein the term "anionic surfactant" is intended to refer to the class of anionic and mixed anionic-nonionic detergents providing detersive action.

Suitable water-soluble non-soap, anionic surfactants include those surface-active or detergent compounds which contain an organic hydrophobic group containing generally 8 to 26 carbon atoms and preferably 10 to 18 carbon atoms in their molecular structure and at least one water-solubilizing group selected from the group of sulfonate, sulfate and carboxylate so as to form a water-soluble detergent. Usually, the hydrophobic group will include or comprise a $C_8$–$C_{22}$ alkyl, alkyl or acyl group. Such surfactants are employed in the form of water-soluble salts and the salt-forming cation usually is selected from the group consisting of sodium, potassium, ammonium, magnesium and mono-, di- or tri-$C_2$–$C_3$ alkanolammonium, with the sodium, magnesium and ammonium cations again being preferred.

Examples of suitable sulfonated anionic surfactants are the well known higher alkyl mononuclear aromatic sulfonates such as the higher alkyl benzene sulfonates containing from 10 to 16 carbon atoms in the higher alkyl group in a straight or branched chain, $C_8$–$C_{15}$ alkyl toluene sulfonates and $C_8$–$C_{15}$ alkyl phenol sulfonates.

A preferred sulfonate is linear alkyl benzene sulfonate having a high content of 3-(or higher) phenyl isomers and a correspondingly low content (well below 50%) of 2-(or lower) phenyl isomers, that is, wherein the benzene ring is preferably attached in large part at the 3 or higher (for example, 4, 5, 6 or 7) position of the alkyl group and the content of the isomers in which the benzene ring is attached in the 2 or 1 position is correspondingly low. Particularly preferred materials are set forth in U.S. Pat. No. 3,320,174.

Other suitable anionic surfactants are the olefin sulfonates, including long-chain alkene sulfonates, long-chain hydroxyalkane sulfonates or mixtures of alkene sulfonates and hydroxyalkane sulfonates. These olefin sulfonate detergents may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred olefin sulfonates contain from 14 to 16 carbon atoms in the R alkyl group and are obtained by sulfonating an a-olefin.

Other examples of suitable anionic sulfonate surfactants are the paraffin sulfonates containing 10 to 20, preferably 13 to 17, carbon atoms. Primary paraffin sulfonates are made by reacting long-chain alpha olefins and bisulfites and paraffin sulfonates having the sulfonate group distributed along the paraffin chain are shown in U.S. Pat. Nos. 2,503,280; 2,507,088; 3,260,744; 3,372,188; and German Patent 735,096.

Examples of satisfactory anionic sulfate surfactants are the $C_8$–$C_{18}$ alkyl sulfate salts and the $C_8$–$C_{18}$ alkyl sulfate salts and the $C_8$–$C_{18}$ alkyl ether polyethenoxy sulfate salts having the formula $R(OC_2H_4)n\ OSO_3M$ wherein n is 1 to 12, preferably 1 to 5, and M is a solubilizing cation selected from the group consisting of sodium, potassium, ammonium, and mono-, di- and triethanol ammonium ions. The alkyl sulfates may be obtained by sulfating the alcohols obtained by reducing glycerides of coconut oil or tallow or mixtures thereof and neutralizing the resultant product.

On the other hand, the alkyl ether polyethenoxy sulfates are obtained by sulfating the condensation product of ethylene oxide with a $C_8$–$C_{18}$ alkanol and neutralizing the resultant product. The alkyl sulfates may be obtained by sulfating the alcohols obtained by reducing glycerides of coconut oil or tallow or mixtures thereof and neutralizing the resultant product. On the other hand, the alkyl ether polyethenoxy sulfates are obtained by sulfating the condensation product of ethylene oxide with a $C_8$–$C_{18}$ alkanol and neutralizing the resultant product. The alkyl ether polyethenoxy sulfates differ from one another in the number of moles of ethylene oxide reacted with one mole of alkanol. Preferred alkyl sulfates and preferred alkyl ether polyethenoxy sulfates contain 10 to 16 carbon atoms in the alkyl group.

The $C_8$–$C_{12}$ alkylphenyl ether polyethenoxy sulfates containing from 2 to 6 moles of ethylene oxide in the molecule also are suitable for use in the inventive compositions. These surfactants can be prepared by reacting an alkyl phenol with 2 to 6 moles of ethylene oxide and sulfating and neutralizing the resultant ethoxylated alkylphenol.

Other suitable anionic detergents are the $C_9$–$C_{15}$ alkyl ether polyethenoxyl carboxylates having the structural formula $R(OC_2H_4)_nOX$ COOH wherein n is a number from 4 to 12, preferably 5 to 10 and X is selected from the group consisting of $CH_2$, $C(O)R_1$ and

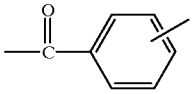

wherein $R_1$ is a $C_1$–$C_3$ alkylene group. Preferred compounds include $C_9$–$C_{11}$ alkyl ether polyethenoxy (7–9) C(O) $CH_2CH_2COOH$, $C_{13}$–$C_{15}$ alkyl ether polyethenoxy (7–9)

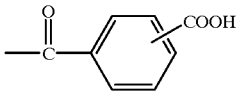

and $C_{10}$–$C_{12}$ alkyl ether polyethenoxy (5–7) $CH_2COOH$. These compounds may be prepared by condensing ethylene oxide with appropriate alkanol and reacting this reaction product with chloracetic acid to make the ether carboxylic acids as shown in U.S. Pat. No. 3,741,911 or with succinic anhydride or phtalic anhydride.

Obviously, these anionic detergents will be present either in acid form or salt form depending upon the pH of the final composition, with the salt forming cation being the same as for the other anionic detergents.

Of the foregoing non-soap anionic surfactants, the preferred surfactants are the $C_9$–$C_5$ linear alkylbenzene sulfonates and the $C_{13}$–$C_{17}$ paraffin or alkane sulfonates. Particularly, preferred compounds are sodium $C_{10}$–$C_{13}$ alkylbenzene sulfonate and sodium $C_{13}$–$C_{17}$ alkane sulfonate.

Generally, the proportion of the nonsoap-anionic surfactant will be in the range of 0.1% to 5%, preferably from 0.4% to 3%, by weight of the dilute o/w microemulsion composition or the all purpose hard surface cleaning composition.

Suitable cosurfactants for the microemulsion over temperature ranges extending from 5° C. to 43° C. for instance are glycerol, ethylene glycol, water-soluble polyethylene glycols having a molecular weight of 300 to 1000, polypropylene glycol of the formula $HO(CH_3CHCH_2O)nH$ wherein n is a number from 2 to 18, mixtures of polyethylene glycol and polypropyl glycol (Synalox) and mono $C_1$–$C_6$ alkyl ethers of ethylene glycol and propylene glycol having the structural formula $R(X)_nOH$ wherein R is $C_1$–$C_6$ alkyl group, X is $(OCH_2CH_2)$ or $(OCH_2(CH_3)CH)$ and n is a number from 1 to 4, diethylene glycol, triethylene glycol, 1methoxy-2-propanol, 1methoxy-3-propanol, and 1methoxy 2-3- or 4-butanol, and triethyl phosphate. Additionally, mixtures of two or more of the three classes of cosurfactant compounds may be employed where specific pH's are desired.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol phenyl ether and 1-phenoxy-2-propanol, ethylene glycol monoacetate and dipropylene glycol propionate.

The thickener which is used in the instant microemulsion is selected from the group consisting of hydrophobically modified polymers like Carbopol 614 manufactured by B. F. Goodrich Co. and Polygel K200, xanthan gum and Laponite caly manufactured by Southern Clay. One of the preferred thickeners, a xanthan gum called Keltrol T and sold by Merck & Co. The xanthan gum is an exocellular hetropolysaccharide having a molecular weight of about 1,000,000 to 10,000,000 and is used in a concentration of weight percent to about 1.0 weight percent, more preferably about 0.1 to about 0.7 weight percent, and most preferably 0.2 to 0.6 weight percent. When used at these concentration levels, the composition retains its microemulsion characteristics in that the essential micellar aggregates are maintained. The composition is still sprayable and will nicely cling to a vertical wall. Additionally, the compositions having the xanthan gum incorporates therein are shear thinning which means that the composition can be easily removed from the surface being cleaned without much mechanical action.

The final essential ingredient in the inventive microemulsion compositions having improved interfacial tension properties is water. The proportion of water in the microemulsion cleaning composition compositions generally is in the range of 20% to 99%, preferably 70% to 98% by weight.

As believed to have been made clear from the foregoing description, the dilute o/w microemulsion liquid detergent cleaning compositions of this invention are especially effective when used as is, that is, without further dilution in water, since the properties of the composition as an o/w microemulsion are best manifested in the neat (undiluted) form. However, at the same time it should be understood that depending on the levels of surfactants, cosurfactants, perfume and other ingredients, some degree of dilution without disrupting the microemulsion, per se, is possible. For example, at the preferred low levels of active surfactant compounds (i.e., primary anionic and nonionic detergents) dilutions up to 50% will generally be well tolerated without causing phase separation, that is, the microemulsion state will be maintained.

On the other hand, it is also within the scope of this invention to formulate highly concentrated microemulsions which will be diluted with additional water before use.

The cleaning composition of this invention may, if desired, also contain other components either to provide additional effect or to make the product more attractive to the consumer. The following are mentioned by way of example: Colors or dyes in amounts up to 0.5% by weight; bactericides in amounts up to 1% by weight; preservatives or antioxidizing agents, such as formalin, 5-bromo-5-nitro-dioxan-1,3; 5-chloro-2-methyl4-isothaliazolin-3-one, 2,6-di-tert.butyl-p-cresol, etc., in amounts up to 2% by weight; and pH adjusting agents, such as sulfuric acid or sodium hydroxide, as needed. Furthermore, if opaque compositions are desired, up to 4% by weight of an opacifier may be added. In final form, the clear microemulsions exhibit stability at reduced and increased temperatures. More specifically, such compositions remain clear and stable in the range of 5° C. to 50° C., especially 10° C. to 43° C. Such compositions exhibit a pH of at least 12.5 and preferably at least about 13.0. The liquids are readily pourable.

Because the compositions as prepared are aqueous liquid formulations and since no particular mixing is required to form the microemulsion, the compositions are easily prepared simply by combining all the ingredients in a suitable vessel or container. The order of mixing the ingredients is not particularly important and generally the various ingredients can be added sequentially or all at once or in the form of aqueous solutions of each or all of the primary surfactants and cosurfactants can be separately prepared and combined with each other and with the perfume. It is not necessary to use elevated temperatures in the formation step and room temperature is sufficient.

The instant microemulsion formulas explicitly exclude alkali metal silicates and alkali metal builders such as alkali metal polyphosphates, alkali metal carbonates, alkali metal phosphonates and alkali metal citrates.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing at 25° C.:

| | A | B |
|---|---|---|
| Tripropylene glycol n-butyl ether | 2.6 | 2.6 |
| Dipropylene glycol n-propyl ether | 5.3 | 5.3 |
| Tripropylene glycol methyl ether | 2.6 | 2.6 |
| Triethanol amine | 1.0 | 1.0 |
| Sodium linear alkyl benzene sulfonate | 4.76 | 4.76 |
| Perfume(a) | 0.5 | 0.5 |

-continued

| | A | B |
|---|---|---|
| NaOH (50%) | 0.75 | 0.75 |
| Xanthan gum | — | 0.4 |
| Water | bal. | bal. |
| Corrosive to skin(b) | No | — |
| Grease removal(c) | 44 | 61 |

(a)contains 25% by weight of terpenes.
(b)In Vitro Corrosion Assay using Epiderm (EPI-200) 3 and 60 minute exposure (Protocol Institute for In Vitro studies, Gaithersburg, Maryland)
(c)test for grease removal (a) contains 25% by weight of terpenes.

(b) In Vitro Corrosion Assay using Epiderm (EPI-200) 3 and 60 minute exposure (Protocol Institute for In Vitro studies, Gaithersburg, Md.)

(c) test for grease removal

1. Grease Preparation: Grease was slowly rendered at low temperature from 80% ground beef in a conventional frying pan. The stove-top burner was set to the smallest flame possible. The grease was transferred to a separatory funnel where the water was separated from the grease from the rendering process. The grease was then filtered to remove solid matter. The purified grease was stored in a freezer.

2. Preparation of bumt-on grease soil: The purified grease was used at ambient temperature. Stainless steel planchets (Gaum Incorporated, Robbinsville N.J., 2.011" diameter, 0.160" deep, 0.012" thick) were the substrate for the test. Each planchet received 0.15 grams of grease and was cooked at 400 F for 40 minutes. After cooking, the planchets to be tested were allowed to cool for at least one hour.

3. Cleaning: Each soiled planchet was pre-treated with 1.5 mL of test product. The pre-treatment time was 15 minutes at ambient temperature. After the pretreatment time, the burnt-on grease soil was removed by a 5 second rinse with water set at 115 F and flow of 1 gallon per minute.

4. Data Collection: Percent soil removal is determined gravimetrically from the tare weight of the planchet, the weight of soil after cooking and the weight of soil after cleaning.

In summary, the described invention broadly relates to an improvement in microemulsion cleaning compositions containing an anionic surfactant, one of the specified cosurfactants, a hydrocarbon ingredient, an alkali metal hydroxide, triethanol amine, a thickener and water.

What is claimed:

1. A clear microemulsion composition comprising:

(a) 3 to 20 wt. % of at least one water soluble cosurfactant;

(b) 0.1 wt. % to 10 wt. % of an anionic surfactant;

(c) 0.1% to 2.0% of an alkali metal hydroxide;

(d) 0.2 wt. % to 10 wt. % of a water insoluble hydrocarbon, essential oil or a perfume;

(e) 0.1% to 2% of triethanol amine;

(f) 0.01% to 3% of a xanthum gum; and (g) the balance being water, wherein the composition has a pH of at least 12.5 and does not contain polyphosphate or other inorganic or organic builder salts, amine oxide surfactants, an alkyl polyglucoside surfactant, an ethoxylated nonionic surfactant, a zwitterionic surfactant, a fatty acid alkanol amide or an organic compound containing both ethoxylate group and an ester group, carrageenen, cellulose gum, hydroxyethyl cellulose, methyl cellulose, hydropropyl methyl cellulose, alumina, polygenic silicas, polyacrylic acid, polymethacrylic acid and polyethylene glycol.

2. The microemulsion composition of claim 1 wherein the cosurfactant is a water soluble glycol ether.

3. The microemulsion composition of claim 1 wherein the glycol ether is selected from the group consisting of ethylene glycol monobutylether, diethylene glycol monobutyl ether, triethylene glycol monobutylether, poly-propylene glycol having an average molecular weight of from 200 to 1,000 and propylene glycol tert.butyl ether, mono-, di-, tri-propylene glycol monobutyl ether. Tripropylene glycol n-butyl ether.

4. The microemulsion composition of claim 3 wherein the glycol ether is tripropylene glycol n-butyl ether, dipropylene glycol n-propyl ether and tripropylene glycol methyl ether.

5. The microemulsion composition of claim 1 wherein the anionic surfactant is a $C_9$–$C_{15}$ alkyl benzene sulfonate or a $C_{10}$–$C_{20}$ alkane sulfonate.

6. The composition of claim 1, wherein said alkali metal hydroxide is sodium hydroxide.

* * * * *